US007047615B2

(12) United States Patent
Norek

(10) Patent No.: US 7,047,615 B2
(45) Date of Patent: May 23, 2006

(54) FORMING GAS TURBINE TRANSITION DUCT BODIES WITHOUT LONGITUDINAL WELDS

(76) Inventor: Richard S. Norek, 8 Garrison Dr., Eliot, ME (US) 03903

( * ) Notice: Subject to any disclaimer, the term of this patent is extended or adjusted under 35 U.S.C. 154(b) by 4 days.

(21) Appl. No.: 10/709,065

(22) Filed: Apr. 9, 2004

(65) Prior Publication Data

US 2005/0132573 A1 Jun. 23, 2005

Related U.S. Application Data

(63) Continuation-in-part of application No. 10/139,494, filed on May 6, 2002, now abandoned.

(51) Int. Cl.
*B23P 17/00* (2006.01)
*B21D 26/02* (2006.01)

(52) U.S. Cl. ..... 29/421.1; 29/890.14; 72/56

(58) Field of Classification Search ..... 29/421.1, 29/890.14, 890.141, 890.144, 890.147, 897.2, 29/890.053, 890.054, 447; 72/56–62
See application file for complete search history.

(56) References Cited

U.S. PATENT DOCUMENTS

| | | | | |
|---|---|---|---|---|
| 3,068,562 | A * | 12/1962 | Long | 228/104 |
| 4,449,281 | A * | 5/1984 | Yoshida et al. | 29/421.1 |
| 4,759,111 | A * | 7/1988 | Cudini | 29/523 |
| 5,129,253 | A * | 7/1992 | Austin et al. | 72/370.07 |
| 5,524,342 | A * | 6/1996 | Swain et al. | 29/895.212 |
| 5,649,439 | A * | 7/1997 | Schulz | 72/62 |
| 5,735,156 | A * | 4/1998 | Yoshitomi et al. | 72/57 |
| 6,332,346 | B1 * | 12/2001 | Komiya et al. | 72/58 |

* cited by examiner

*Primary Examiner*—Marc Jimenez
(74) *Attorney, Agent, or Firm*—Phillip E. Decker; Mesmer & Deleault, PLLC

(57) ABSTRACT

A method of making combustion turbine transition duct bodies without longitudinal welds by hydroforming two duct bodies back to back with bellows thrusters secured to the duct body open ends. This enables the manufacturing of duct bodies with detailed features and high pressure without using compression cylinders. Multi-layer transition duct bodies can also be assembled with layers of different materials, for example, having a heat-resistant layer inside and high strength layer outside. They can be assembled using cold shrinking and heat expanding. In addition, anti-fretting and anti-vibration coatings can be applied between the layers for improved performance.

11 Claims, 7 Drawing Sheets

FORMING GAS TURBINE TRANSITION DUCT BODIES WITHOUT LONGITUDINAL WELDS

This application is a continuation-in-part of Ser. No. 10/139,494, filed May 6, 2002, now abandoned.

BACKGROUND OF INVENTION

1. Field of the Invention

This invention relates to methods for hydroforming transition duct bodies used in gas turbines.

2. Description of the Related Art

Associated with gas turbines having multiple cannular combustors are transition ducts that carry hot gases from the combustors to the turbine inlet as shown schematically in FIG. 1. The combustors 12 are round, but the turbine inlet is annular. Therefore, the transition duct bodies 10 must have round inlets 16 and an exit 18 that forms a segment of an annulus.

The highly curved walls of the duct body 10 are difficult to fabricate. The difficulty is compounded by an offset 14 between the duct inlet 16 and duct exit 18. The offset 14 is the distance between the centerline of the combustor 12 and the centerline of the duct exit 18.

According to the current art, large transition pieces are fabricated by welding together a number of individual components. The largest component is the main body of the duct 10 shown in FIG. 2. It is typically made of two curved shells 20 and 22 that are stamped separately, trimmed to size, and then welded together. The welds 11 are shown in FIG. 1.

To facilitate removal from the dies after stamping of the two separate parts, the joints between these parts must pass through the widest contour lines on the sides of the duct body 10. Consequently, the longitudinal welds 11 terminate in the highly stressed upper corners of the duct exit 18 and have the effect of weakening these corners. This makes the longitudinal welds undesirable.

In addition, some duct bodies 10 require circumferential welds. Circumferential welds would be needed, for instance, to attach a frame for exit seals or support brackets, not shown in the drawing. They would cross the longitudinal welds in the duct bodies 10, thus producing more weak spots. Inherently, welding causes weld distortion. To achieve the required dimensional tolerances, special fixtures are typically required for welding, stress relieving, and heat treatment.

The current methods of fabrication are difficult and costly. Some large transition duct bodies cost more than a full-size automobile, each. A set of four to fourteen transition ducts per gas turbine represents a prime target for cost reduction.

Considerable progress was achieved by Yoshitomi et al, U.S. Pat. No. 5,735,156, which is not admitted to being prior art by its mention in this Background section. Yoshitomi et al use liquid pressure to make two transition pieces out of one work piece in one forming operation. The work piece could be a straight pipe or a combination of straight and conical pipes. To form a pressure vessel, the ends of the work piece are sealed with conical plungers thrust against the pipe ends by hydraulic cylinders. The pipe ends are held in the horizontally split, massive frame that encases the upper and lower dies which hydroform the work piece. The apparatus is complicated. It consists of split dies and a split frame that holds the work piece and requires five hydraulic cylinders to operate.

What is needed, therefore, is a less costly method for making stronger transition duct bodies that does not require longitudinal welding.

SUMMARY OF INVENTION

An invention that satisfies the need for a less costly method for making stronger transition duct bodies that does not require longitudinal welding comprises hydroforming one or more transition duct bodies between two dies in a hydroforming press from seamless pipe sealed with bellows thrusters. Bellows thrusters are structurally welded to the open end of the duct body. The thrusters preferably have bellows built into them for increasing lateral force on the duct body during hydroforming. The bellows can be uniform around the hemispherical axis, or can be non-uniform. These and other features, aspects, and advantages of the present invention will become better understood with regard to the following description, claims, and accompanying drawings.

DETAILED DESCRIPTION

Figure 1:
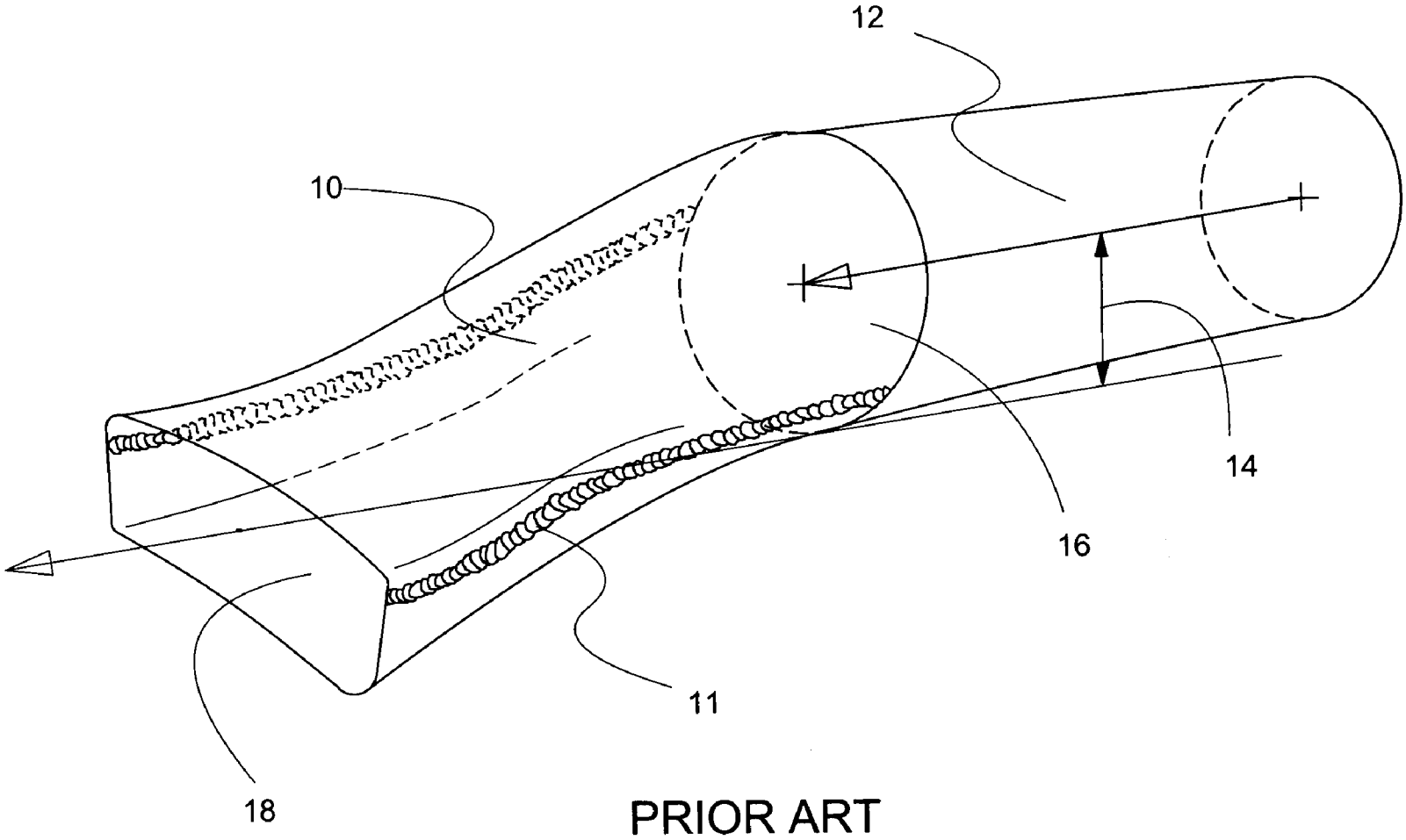
PRIOR ART Fig. 1
FIG. 1 is a perspective view of a transition duct body assembly of the prior art.
Figure 2:
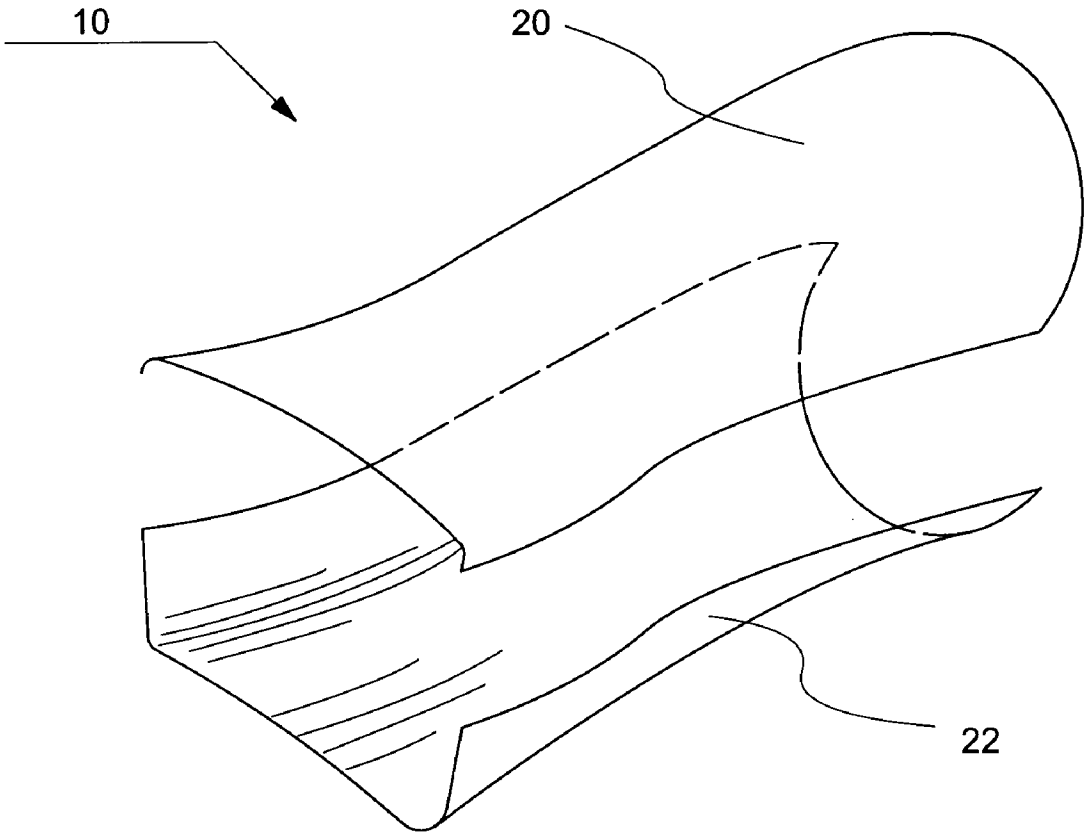
PRIOR ART Fig. 2
FIG. 2 is a perspective view of two components of a transition duct body assembly before welding according to the prior art.

The purpose of the invention is to produce stronger, better, and less costly transition ducts by improving transition duct bodies. The novel method of the present invention comprises hydroforming at least one transition duct body from a pipe by pressurizing the pipe between two dies in a hydroforming press, preferably using bellows thrusters welded to the ends of the duct body. A seamless pipe is necessary to produce transition duct bodies with no longitudinal welds.

The process starts by structurally welding a bellows thruster 82 on at least one end of a seamless pipe work piece 50, and placing it between a lower hydroforming die 26 and an upper hydroforming die 24. If a tee is being hydroformed, then there can be more thrusters. Fluid nozzles 34 are attached through the bellows thrusters 28 to enable filling and draining the working fluid from inside the work piece. The thrusters are preferably made to fit inside hemispherical recesses in the upper and lower dies. The bellows structure 82 can be formed before welding to the work piece.

Figure 3:
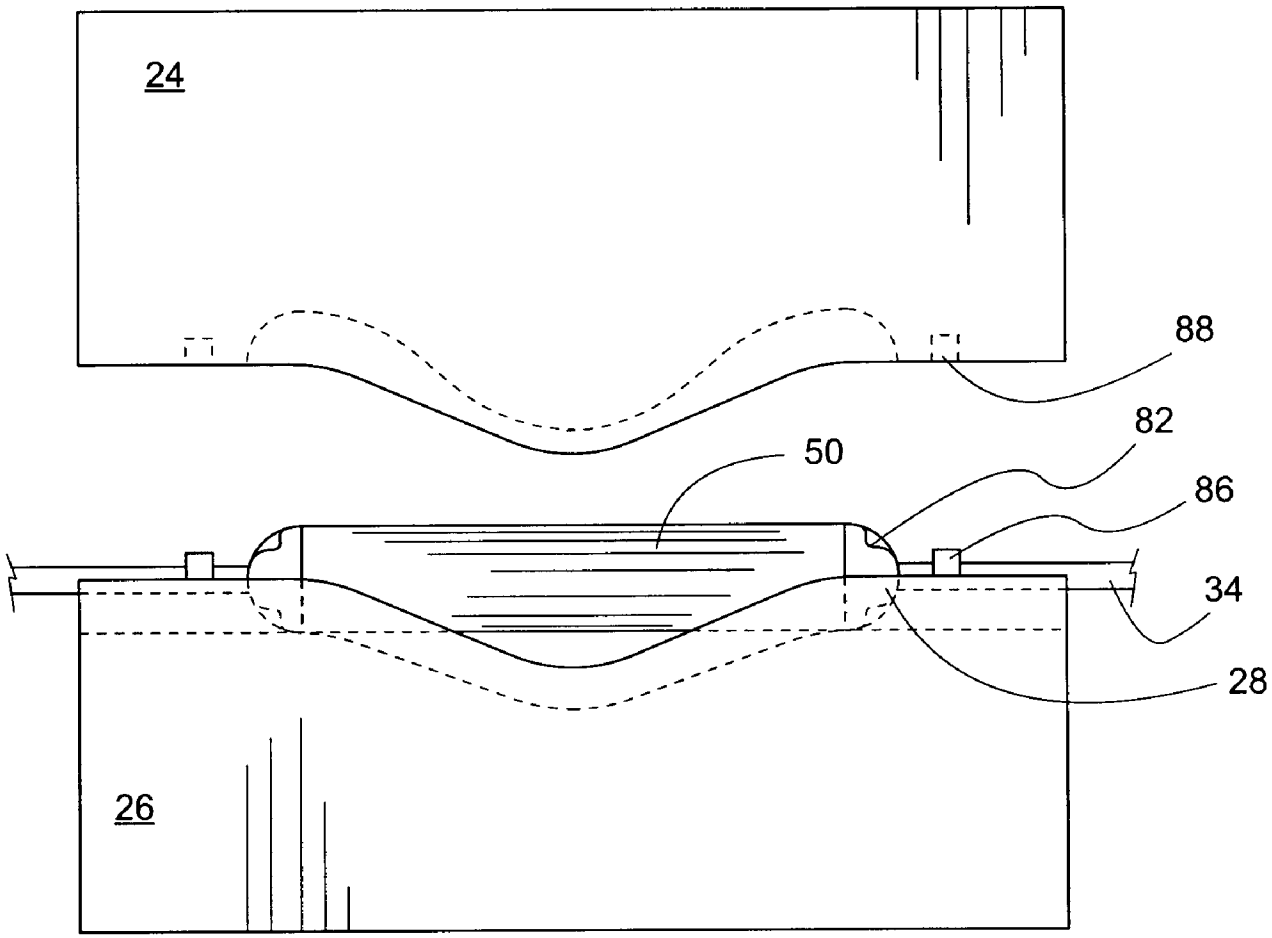
FIG. 3 is a side elevation of hydroforming dies and a seamless pipe ready for hydroforming according to the present invention.

FIG. 3 also shows that the fluid nozzles 34 are optionally clamped with a clamp 86 to the lower die. This is to prevent twisting when the upper die 24 begins deforming the work piece 50. Recesses 88 are provided in the upper die 24 to receive the clamps 86 when the dies are closed.

Figure 4:
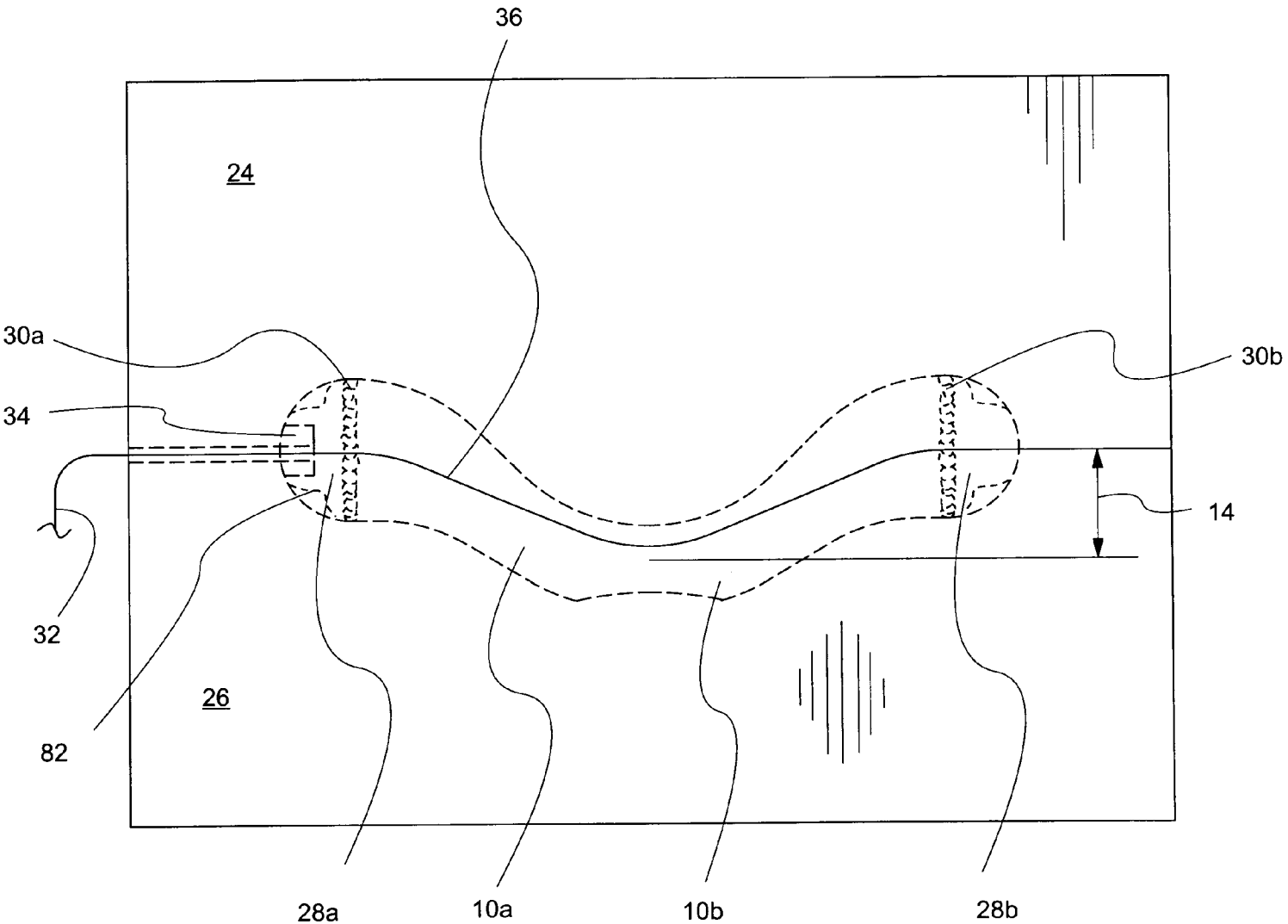
FIG. 4 is a side elevation of the hydroforming dies of FIG. 3 after hydroforming.

Two duct pieces 10*a* and 10*b* formed in a back to back relationship are shown FIG. 4. In order to avoid complicated sealing of the annular segment at the transition duct body exit 18, the two duct bodies are formed together, back to back, or exit to exit. After hydroforming, the joined exits of the duct bodies can be separated by laser cutting or other means to obtain two transition duct bodies 10*a* and 10*b*.

To pressurize the pipe, in one embodiment, both ends must be sealed and provision made for injecting water under high pressure to the pipe interior, precise control of the water pressure during the hydroforming process, and the discharge of water after hydroforming. The required maximum hydroforming pressure depends on the duct overall size, wall thickness, wall material, the smallest radius in the dies, and the capacity of the press holding the dies. The existing large hydroforming presses capacity of 13,600 kg (15,000 tons), and the hydroforming pressure capacity of 4,000 bar (58,000 psi) are likely to satisfy the most of the existing transition duct body 10 hydroforming requirements. Refer to the Erie Press System, 1253 West 12th Street, Erie, Pa. 10512; and 3 Dimensional Services, 2547 Product Drive, Rochester Hills, Mich. 48309.

Such rotation takes place due to bending of the pipe to produce an offset 14 between the duct inlet and the exit. The greater the offset 14, the more bending occurs, the more the caps 28*a* and 28*b* rotate, and the more the ends move inward.

In the arrangement shown in FIG. 3, an inner fluid nozzle assembly 34 for introducing a fluid source 32 must be secured to one of the bellows thrusters 28 before the thruster is structurally welded to the tubular pipe. Securing in the preferred embodiment is done by structural welds 30*a* and 30*b*. The nozzle 34 is for admitting a working fluid for the hydroforming, like water, oil, air, or other suitable fluid.

Figure 5:
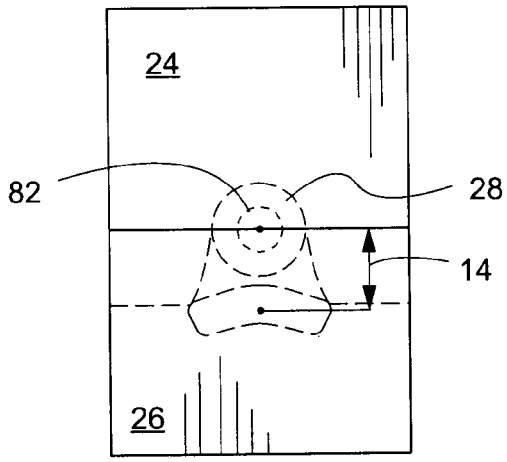
FIG. 5 is a front elevation of the hydroforming dies of FIG. 4.

FIGS. 4 and 5 clearly show the result of two duct bodies 10*a* and 10*b* being formed together, with their exit ends facing each other and joined. They are shown as dashed lines because they are inside the hydroforming apparatus. The novel bellows feature 82 of the thrusters 28 is described more fully below.

Figure 7:
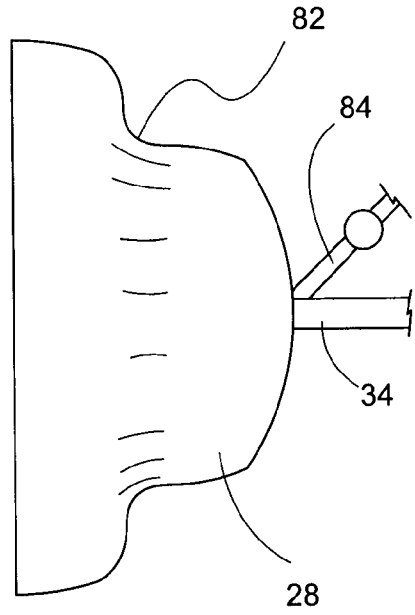
FIG. 7 is a side elevation of the bellows thruster of FIG. 6.
Figure 6:
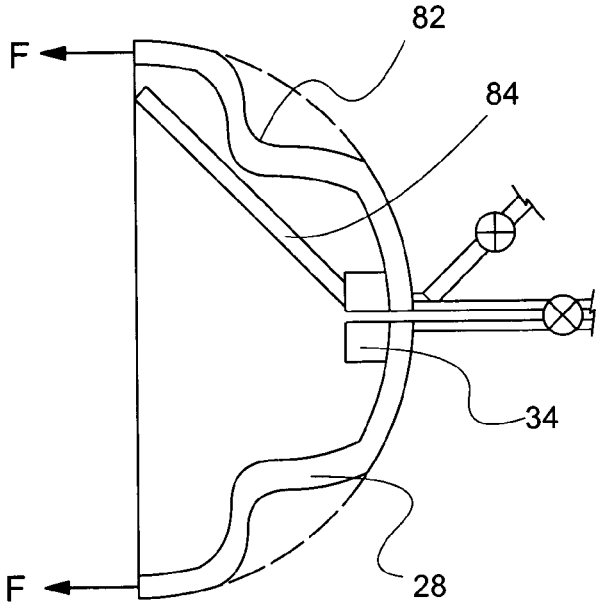
FIG. 6 is a sectional view of thrusters having bellows structure that is uniform around its axis.

FIG. 6 is a sectional view of a novel bellows thruster 28 according to the present invention. FIG. 6 is a side elevation of the thruster 28 that indicates the bellows 82 shape is uniform around the bellows thruster 28. The pressure inside a pressure vessel exerts the same force per unit area at all inside points of a pressure vessel. For design purposes, one must always treat the work piece being hydroformed as a thin-walled vessel. The internal pressure must be balanced by forces along the skin of the vessel. The effect of the bellows shape 82 in the bellows thruster 28 is to increase the area in that part of the assembly, and therefore increase the force transmitted to the work piece. If one were not hydroforming, the forces would be in tension. However, in hydroforming, the net force is compression, which is represented by the force vector arrows in FIG. 6. An air vent 84 should be provided to remove air as the work piece is being filled with its working fluid. Note that the tip of the air vent 84 inside the work piece is near the top, where the air would collect. FIG. 7 is a side elevation of the symmetrical bellows shown in FIG. 6.

Figure 8:
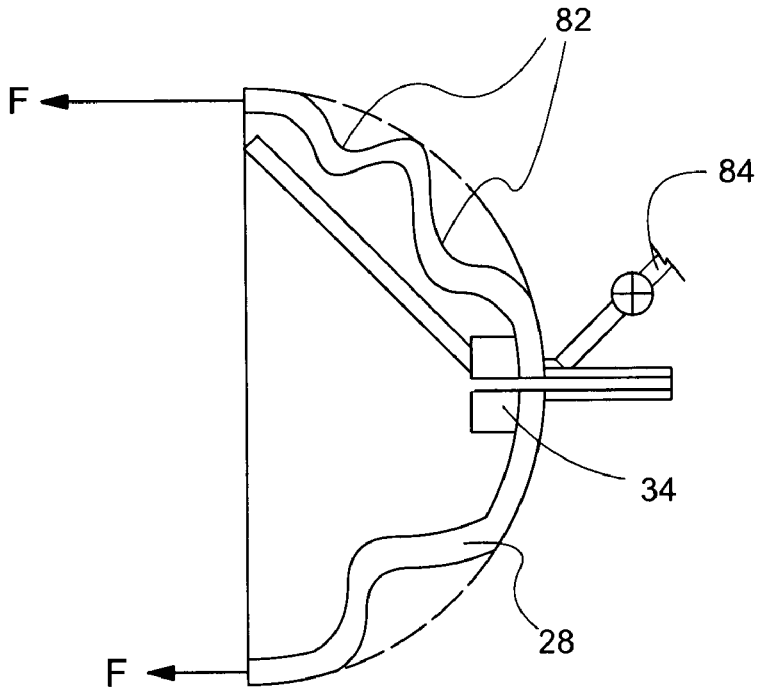
FIG. 8 is a sectional view of thrusters having an asymmetrical bellows structure.
Figure 9:
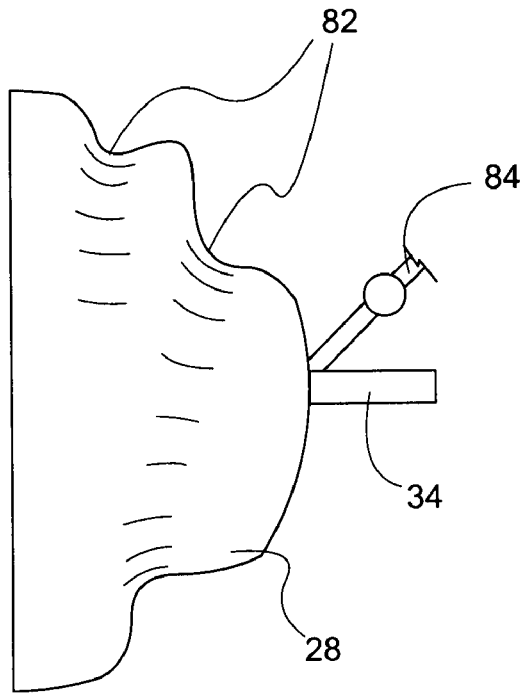
FIG. 9 is a side elevation of the bellows thruster of FIG. 8.

Another version is shown in FIG. 8 and FIG. 9. They show a more complex bellows 82 having two ridges on one side, and one on the other. The result is that a greater force is exerted to the work piece on the side with two bellows than the side with only one. This is represented by the larger force vector shown in FIG. 8. More, or fewer, or no bellows sections could be provided per side, depending on the requirements of the particular shape to be formed.

The method of these embodiments can be described as follows. To produce two transition pieces out of one work piece that is a pressure vessel consisting of a cylindrical pipe enclosed by two hemispherical bellows 82. The bellows 82, when pressurized from the inside, become thrusters 28. The bellows/thrusters 28 are disposable. They are structurally welded pressure-tight to the work piece pipe and are altogether enclosed entirely by the forming dies 24, 26. This method of pressure vessel sealing does not limit the system to the maximum limit of systems using conical plungers, which is about 10,000 psi. This method provides higher axial thrust to the edges of the pipe wall that the conical plungers cannot provide.

The axial thrust can vary circumferentially by providing more bellows ripples on one side of the bellows thruster than the other. No hydroforming system in the prior art can do that. Having variable thrust is beneficial for making asymmetrical transition duct pieces, like the ones shown in the drawings. More thrust is needed near the upper portions as shown because the work piece is required to stretch more near the top than the bottom.

The high internal pressure and use of the thrusters 28 with bellows 82 present an opportunity to produce, not only smooth and precise transitions, but also to form novel circumferential ridges that may have multiple functions. First, the ridges will act as wall stiffeners in place of stiffening ribs that are sometimes welded in the current art on the outside of the duct. Such stiffeners formed on the curved walls of the transition near the exit (annular section) may be very effective in raising a natural frequency of the wall away from the peak excitation frequency produced by the hot gases. Second, the ridges could be short on the outer wall and longer on the inner wall of the transition duct, which would ease bending of the transition's "fishtail" section during hydroforming. Third, the ridges would act as cooling ribs. Incidentally, the inner wall runs generally hotter than the outer wall in service, thus the inner wall could use more cooling from longer ridges.

An apparatus to make transition duct pieces according to the present invention will now be described.

APPARATUS AND SETUP

1. Hydroforming press with upper die 24 and lower die 26 to accommodate a tandem work piece 50.

2. The split line 36 between the dies runs along the widest points of the finished product.

3. The work piece is a pressure vessel comprising a pipe and two hemispherical bellows/thrusters 82.

4. The work piece is enclosed between the upper die 24 and lower die 26 together with the hemispherical bellows thrusters 28 with bellows 82.

5. The novel bellows/thruster 82 provides axial force on the pipe edge while the work piece is pressurized. This alleviates wall thinning of the work piece walls during hydroforming.

6. There is no need for axial cylinders to provide axial force to alleviate wall thinning during hydroforming.

7. There is no need for axial plungers to provide sealing of the work piece.

8. There is no need for an external frame to hold axial plungers and axial cylinders.

9. The bellows can be formed to produce more end pipe displacement in the upper die than in the lower die. None of the axial cylinders of the prior art can do that.

Figure 10:
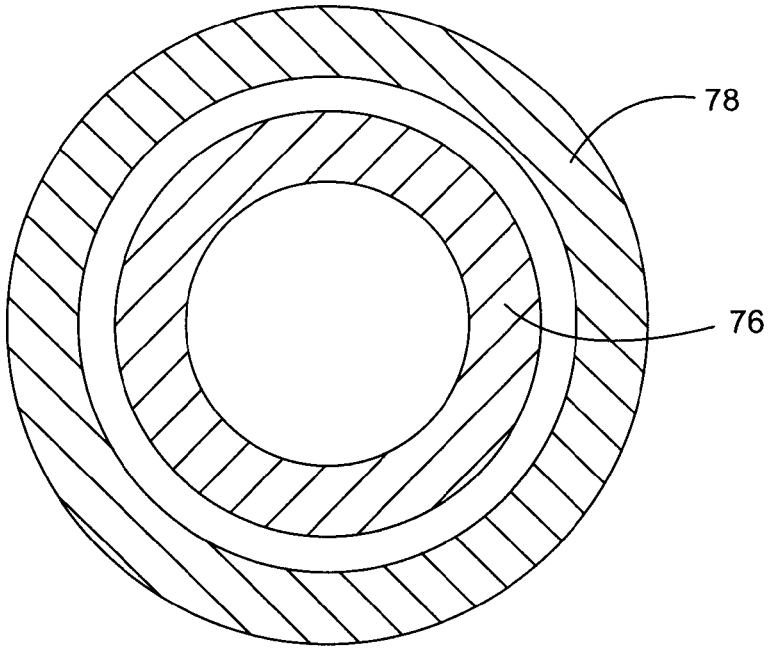
FIG. 10 is a cut-away view of a two-layer transition duct piece.
Figure 11:
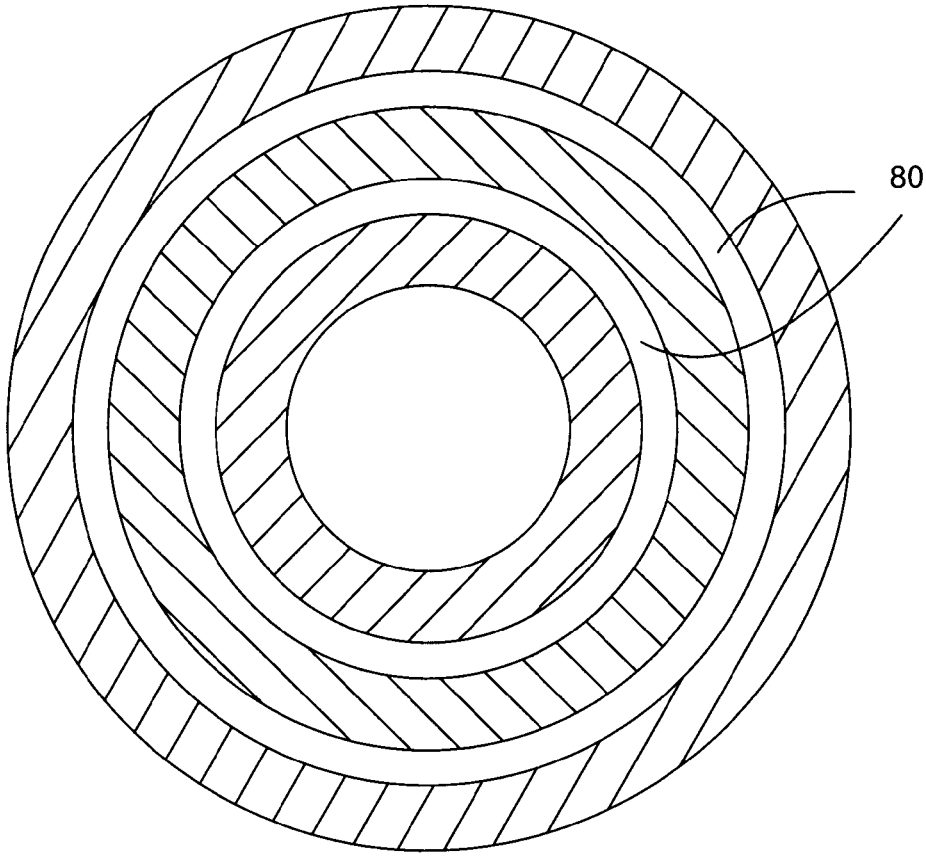
FIG. 11 is a cut-away view of a three-layer transition duct piece.

Another embodiment of a method and apparatus according to the present invention includes making multilayered transition duct bodies, as shown in FIGS. 10 and 11, for example. This is done by providing a plurality of concentric, cylindrical work pieces 50 nested within each other. They are fit together by chilling the inner cylinders and/or heating the outer cylinders with the required dimensional interference to assure structural integrity of the work piece pipe 50.

A two-layer transition duct body provides better material utilization. The inner layer 76 can be made of a relatively more costly heat-resistant material. The outer layer 78 could be made of a relatively less costly material, thus lowering the total cost of the ducts.

A three-layer transition duct, shown in FIG. 11, would have the benefit of being able to dampen vibrations. Special anti-fretting coatings 80 can be applied on the surfaces between the concentric cylinders to increase both fretting resistance and damping. Experience indicates that a three-layered part can provide more damping than a two-layered part inside the turbine environment. The increased damping presents an opportunity to increase the life between removal for all ducts that have not been able to reach the desired minimum target life of 40,000 hours.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

The invention claimed is:

1. A method of making gas turbine transition duct bodies without longitudinal welds comprising the steps of providing at least one hemispherical bellows thruster having a bellows structure, structural welding a bellows thruster to each open end of a duct body such that the duct body is capable of containing internal pressure, removably securing a pressurizing means to at least one of said bellows thrusters capable of pressurizing the inside of a duct body, and hydroforming the transition duct body in a hydroforming press to a pressure less than the capacity of the hydroforming press.

2. The method of claim 1, wherein the bellows structure is uniform around the axis of the hemispherical bellows thruster.

3. A method of making gas turbine transition duct bodies without longitudinal welds comprising the steps of providing at least one hemispherical bellows thruster having a bellows structure, wherein the bellows structure is uniform around the axis of the hemispherical bellows thruster and comprises one ripple around the axis of the bellows thruster structural welding a bellows thruster to each open end of a duct body such that the duct body is capable of containing internal pressure, removably securing a pressurizing means to at least one of said bellows thrusters capable of pressurizing the inside of a duct body, and hydroforming the transition duct body in a hydroforming press to a pressure less than the capacity of the hydroforming press.

4. The method of claim 3, wherein the bellows structure is non-uniform around the axis of the hemispherical bellows thruster.

5. The method of claim 3, wherein the hemispherical bellows thruster bellows structure is adapted to supply more lateral force to the duct body during hydroforming than hemispherical bellows thrusters without bellows.

6. The method of claim 3, further comprising the step of providing a pair of hydroforming dies that when assembled form at least two hemispherical recesses sized to communicate with hemispherical bellows thrusters secured to the duct body during hydroforming.

7. The method of claim 3, adapted to form two transition duct bodies in a back-to-back arrangement, said hydroforming press comprising dies shaped to form two transition duct bodies in a back-to-back arrangement.

8. The method of claim 3, wherein the duct body is a multi-layer transition duct body.

9. The method of claim 8, wherein an anti-fretting material is disposed between an inner layer and an outer layer of the multi-layer transition duct body.

10. A method of making gas turbine transition duct bodies without longitudinal welds comprising the steps of providing at least one hemispherical bellows thruster having a bellows structure, wherein the bellows structure is non-uniform around the axis of the hemispherical bellows thruster and comprises at least two ripples on one side of the bellows thruster, and one ripple on the other aide of the bellows thruster, structural welding a bellows thruster to each open end of a duct body such that the duct body is capable of containing internal pressure, removably securing a pressurizing means to at least one of said bellows thrusters capable of pressurizing the inside of a duct body, and hydroforming the transition duct body in a hydroforming press to a pressure less than the capacity of the hydroforming press.

11. A method of making gas turbine transition duct bodies without longitudinal welds comprising the steps of providing at least one hemispherical bellows thruster having a bellows structure, wherein the bellows structure is non-uniform around the axis of the hemispherical bellows thruster and comprises one ripple around the axis of the bellows thruster, and wherein the hemispherical bellows thruster bellows structure is adapted to supply more lateral force to one side of the duct body during hydroforming than the other, structural welding a bellows thruster to each open end of a duct body such that the duct body is capable of containing internal pressure, removably securing a pressurizing means to at least one of said bellows thrusters capable of pressurizing the inside of a duct body, and hydroforming the transition duct body in a hydroforming press to a pressure less than the capacity of the hydroforming press.

* * * * *